US006092797A

United States Patent [19]

You

[11] Patent Number: 6,092,797

[45] Date of Patent: Jul. 25, 2000

[54] QUICK CLAMPING TYPE VICE

[76] Inventor: Yen-Jen You, 3F, No. 23, Alley 53, Lane 12, Sec. 3, Pa-Der Rd., Taipei, Taiwan

[21] Appl. No.: 09/265,395

[22] Filed: Mar. 10, 1999

[51] Int. Cl.[7] ..... B25B 1/02

[52] U.S. Cl. ..... 269/181; 269/900

[58] Field of Search ..... 269/181, 174, 269/139, 252, 900, 100

[56] References Cited

U.S. PATENT DOCUMENTS

| | | | |
|---|---|---|---|
| 4,199,135 | 4/1980 | Wohrle et al. | 269/901 |
| 4,341,375 | 7/1982 | Romanin | 269/181 |
| 4,395,030 | 7/1983 | Eskuchen | 269/181 |
| 4,415,149 | 11/1983 | Rees | 269/900 |
| 5,941,152 | 8/1999 | Kim | 269/181 |
| 5,970,812 | 10/1999 | Fan et al. | 269/181 |

*Primary Examiner*—David A. Scherbel
*Assistant Examiner*—Daniel G. Shanley
*Attorney, Agent, or Firm*—Dougherty & Troxell

[57] ABSTRACT

A quick clamping type vice in which a chuck and a spring are disposed in a main base seat. The chuck is substantially U-shaped and an inner side of the bottom of the chuck is formed with a semicircular thread facing upward. A cover board is disposed on the upper side of the chuck and locked with the chuck to form an integral body. The spring is disposed right under the chuck. The thread rod passes through the main base seat and ride on the bottom of the chuck. The spring pushed the chuck upward to make the thread of the chuck engaged with the thread rod. When the cover board is depressed, the chuck is vertically moved downward and disengaged from the thread rod. At this time, the thread rod is liberated and can be quickly slided. When releasing the cover board, the spring makes the thread of the chuck again engaged with the thread rod. Accordingly, the clamping and loosening operation of the vice can be quickly performed.

1 Claim, 10 Drawing Sheets

QUICK CLAMPING TYPE VICE

BACKGROUND OF THE INVENTION

The present invention relates to a quick clamping type vice including a vertically up and down movable chuck. A bottom of the chuck is formed with 180 degrees thread. The thread of the chuck can be vertically 180 degrees engaged with or disengaged from a thread rod so that the vice can be conveniently operated with less strength for tightly clamping a work piece or loosening the work piece. The vice is applicable to a carpenter or a cramp working bench or other working sites necessitating clamping of a work piece.

In wood work or bench work, in order to stabilize a work piece, a vice is often used to clamp the work piece. In a conventional vice, a thread rod is connected with a clamping block mounted on a working bench. In both clamping and loosening operation, it is necessary to rotate the thread rod many times. In U.S. patent application Ser. No. 08/905,388 of the present applicant, entitled "a working bench with quick clamping type cramp device", as shown in FIGS. 1 and 2, a quick clamping type vice is disclosed. The vice includes a main base seat 71, a back seat 72, a movable block 73 and a ratchet lever 75. The back seat 72 is spaced from and opposite to the main base seat 71. The movable block 73 is driven by a thread rod 74. The ratchet lever 75 is coupled with the thread rod 74 via an internal ratchet. A oneway release handle 76 formed with a thread is disposed on the main base seat 71 and engaged with the thread rod 74. When using the vice to clamp a work piece 50, the release handle 76 is pressed and shifted to separate the thread thereof from the thread rod 74. At this time, the movable block 73 can be quickly moved to attach to the work piece 50. Then the ratchet lever 75 is rotated several times to drive the movable block 73 to clamp the work piece 50. When releasing the work piece 50, as shown in FIG. 2-1, the pawl 751 is shifted to reversely engage the crank lever 75 with the internal ratchet. Then the crank lever 75 is rotated several times to move the movable block 73 away from the work piece 50. Thereafter, the release handle 76 is pressed to quickly slide the movable block 73 backward. Such structure is able to quickly fixedly clamp the work piece 50. However, the loosening operation of the work piece 50 is relatively troublesome. The thread of the release handle 76 is moved along an arch path so that the thread will slightly force the thread of the thread rod 74 and slightly move the movble block 73 forward. Therefore, when the movable block 73 suffers a pressure in a clamping state, it will be impossible to shift down the release handle 76 so that the movable block 73 cannot be quickly slided.

SUMMARY OF THE INVENTION

It is a primary object of the present invention to provide a quick clamping type vice which can be easily and quickly operated.

It is a further object of the present invention to provide the above quick clamping type vice by which a user can firmly and accurately clamp or loosen a work piece.

It is still a further object of the present invention to provide the above quick clamping, type vice which can be easily and quickly assembled.

It is still a further object of the present invention to provide the above quick clamping type vice in which all the components do not need to be secondarily processed so that the manufacturing cost is reduced.

According to the above objects, the quick clamping type vice of the present invention includes a main body composed of a main base seat, a back seat and clamping block, a chuck assembly composed of a chuck, a spring and a cover board, a thread rod and guide rods. The chuck assembly is received in the main base seat. An upper end of the main base seat is formed with a deep socket for receiving the chuck. The main base seat is also formed with several through holes passing through the front and rear end faces thereof The back seat is disposed opposite to the main base seat. The clamping block is disposed between the main base seat and the back seat. A back face of the clamping block is formed with several holes for the thread rod and guide rods which pass through the main base seat to fixedly insert therein. The chuck has a substantially U-shaped cross-section. A bottom of the inner side of the chuck is formed with a 180 degrees semicircular thread facing upward. An outer side of the bottom of the chuck is formed with a recess in which the spring is positioned and the end face of the spring is stopped. The chuck and the spring are both disposed in the socket of the main base seat with the spring located in the recess of the chuck. The cover board is connected with the chuck as an integral body, whereby by means of depressing the cover board, the chuck is driven to move downward. At this time, the thread of the chuck is disengaged from the thread rod.

The thread rod passes through the main base seat and rides on the chuck to be inserted and locked in the hole of the back face of the clamping block. The guide rods pass through the through holes of the main base seat to fixedly insert into the holes of the back face of the clamping block.

The present invention can be best understood through the following description and accompanying drawings wherein:

BRIEF DESCRIPTION OF THE DRAWINGS

FIG. 2-1 shows the operation of the ratchet lever of FIG. 1;

DETAILED DESCRIPTION OF THE PREFERRED EMBODIMENTS

Figure 1:
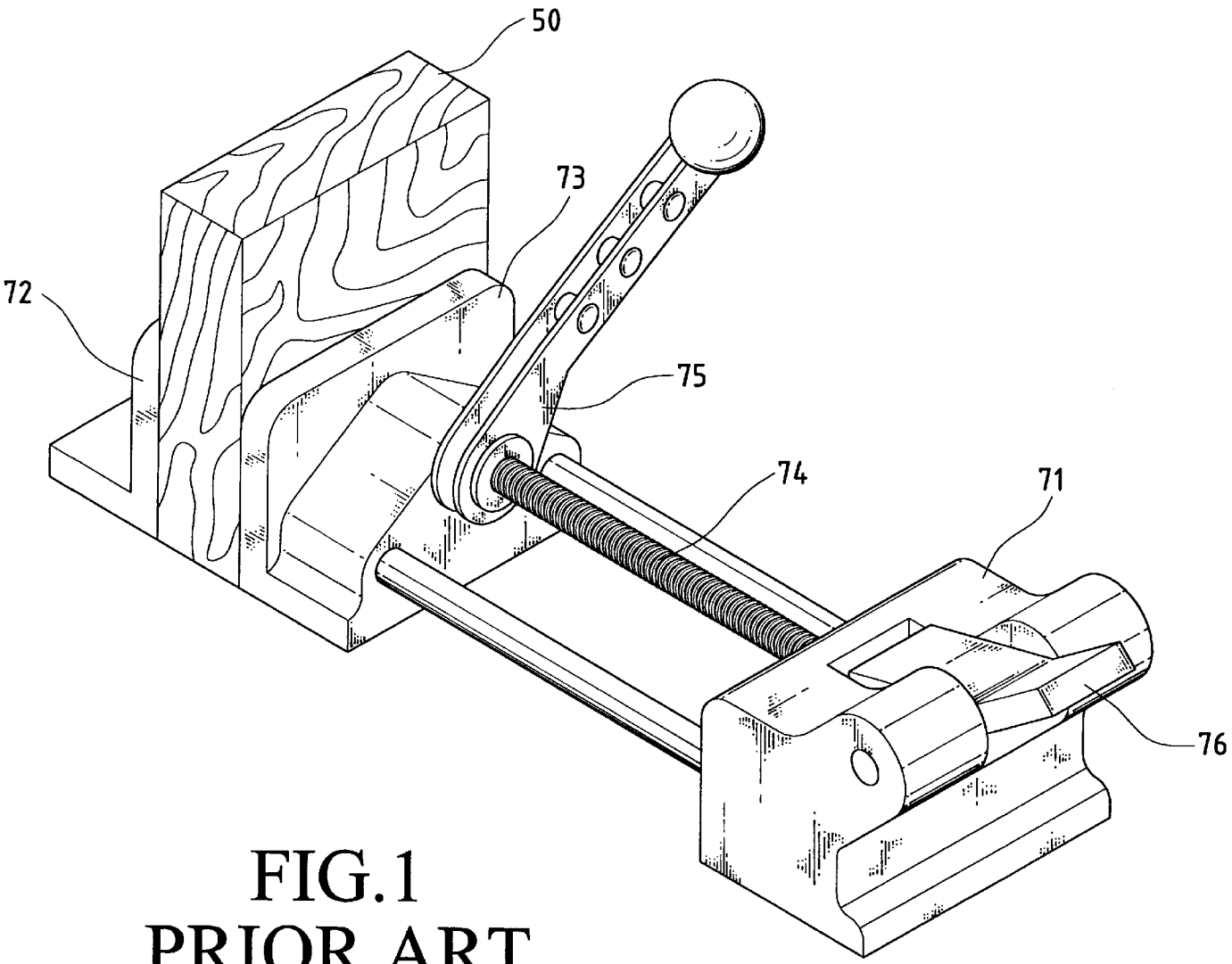
FIG. 1 PRIOR ART
FIG. 1 is a perspective view of a prior quick clamping type vice.
Figure 2:
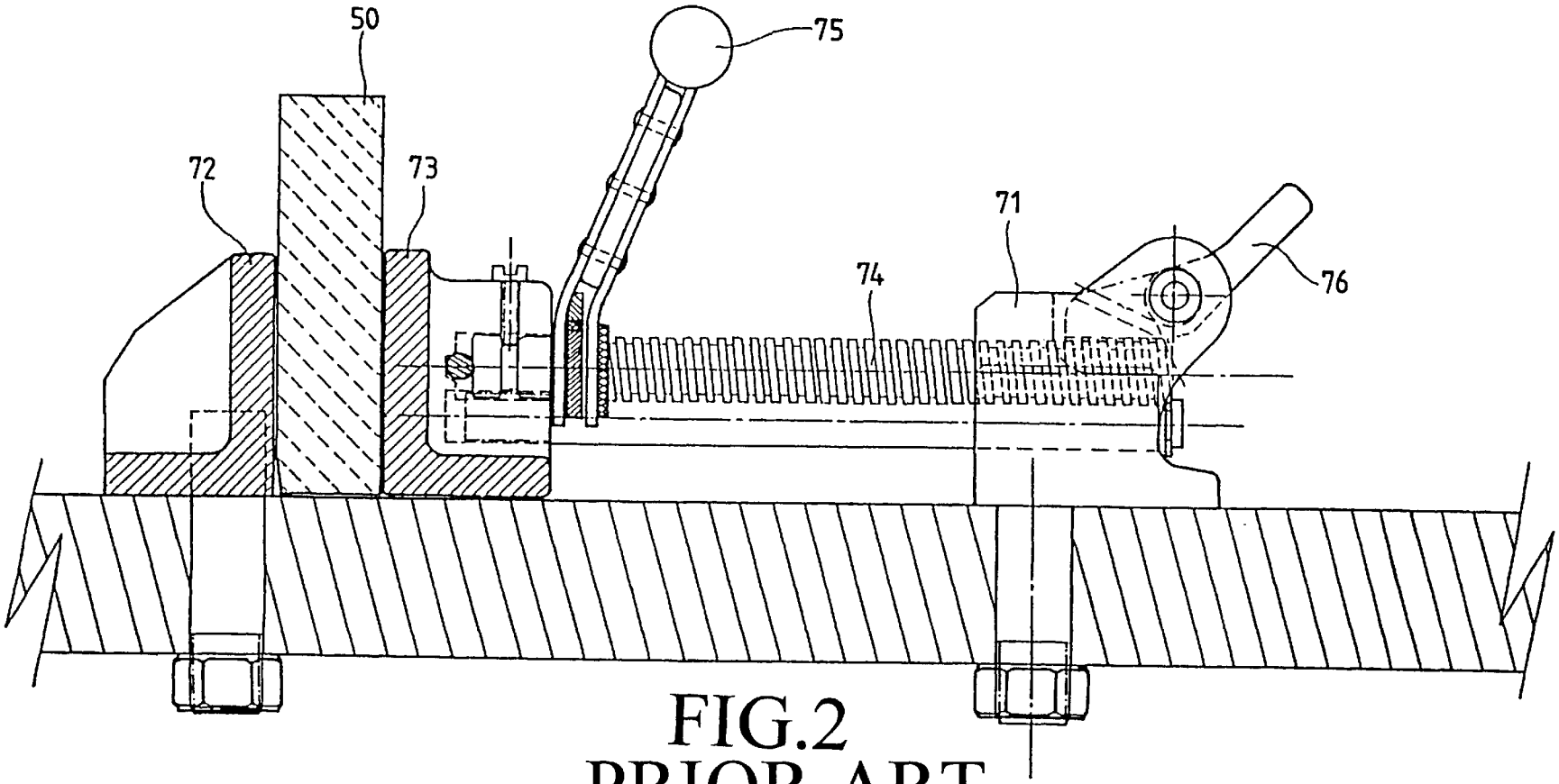
FIG.2 PRIOR ART
FIG. 2 is a cross-sectional view according to FIG. 1.
Figures 1, 2:
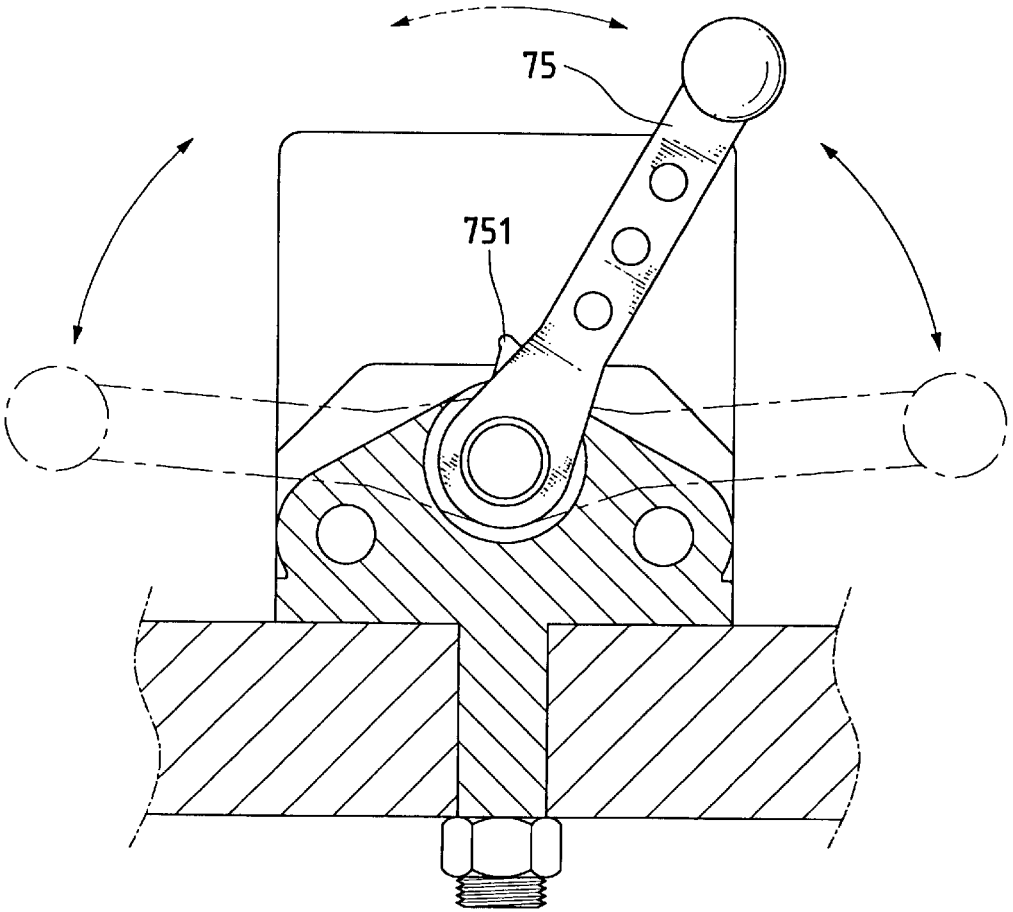
FIG.2-1 PRIOR ART
Figure 3:
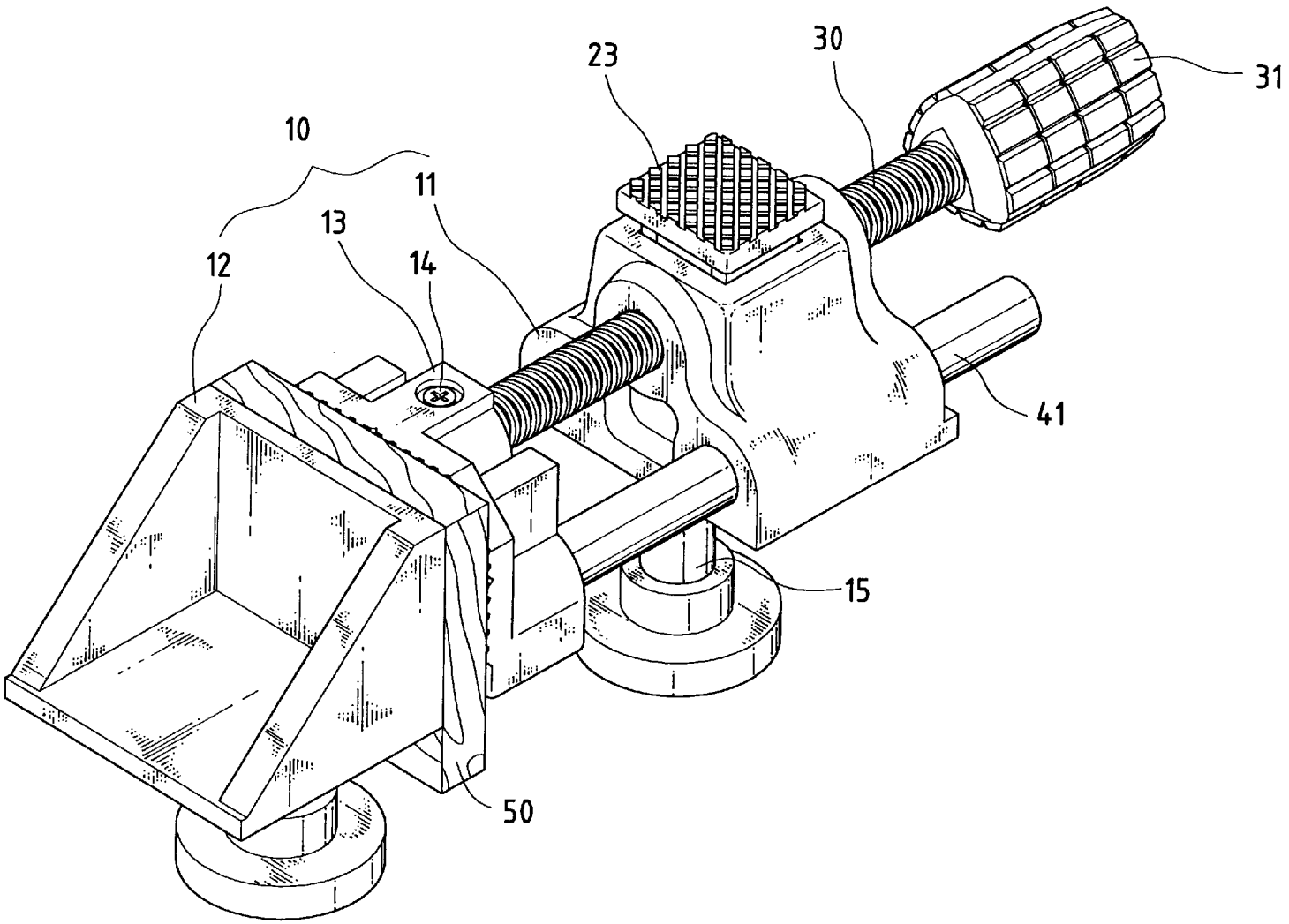
FIG. 3 is a perspective view of a preferred embodiment of the present invention.
Figure 4:
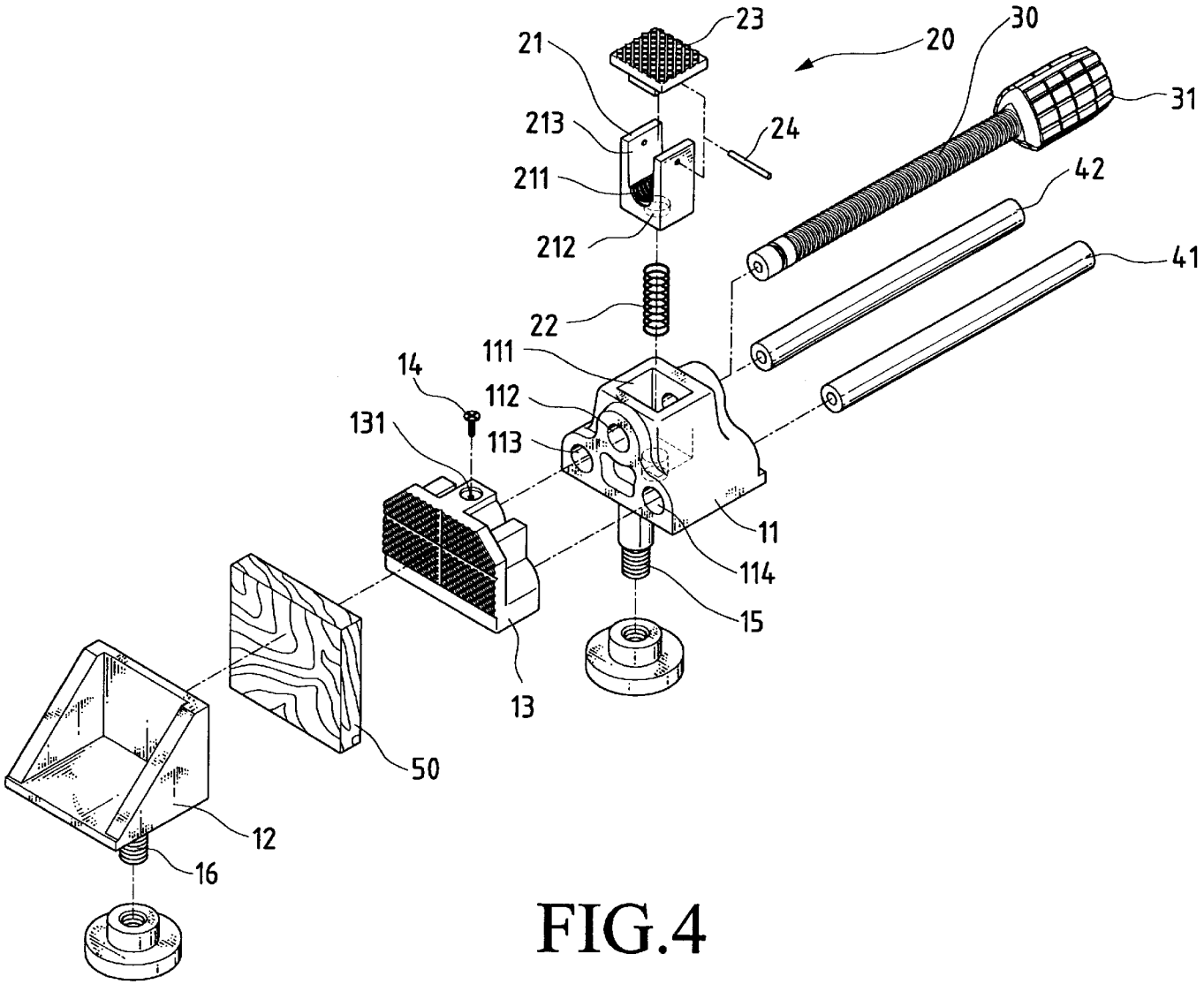
FIG. 4 is a perspective exploded view of the present invention.
Figure 5:
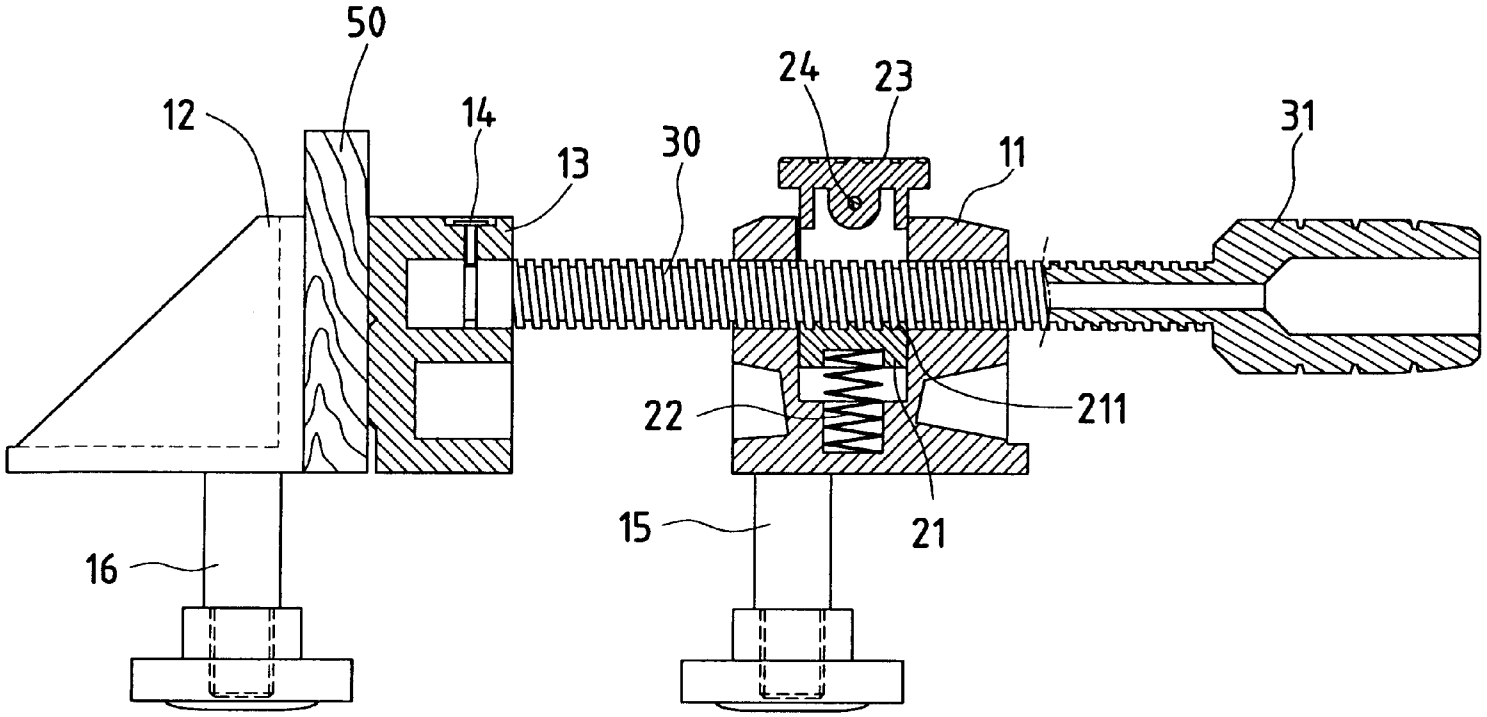
FIG. 5 is a cross-sectional view showing that the thread rod is engaged with the thread of the chuck.
Figure 6:
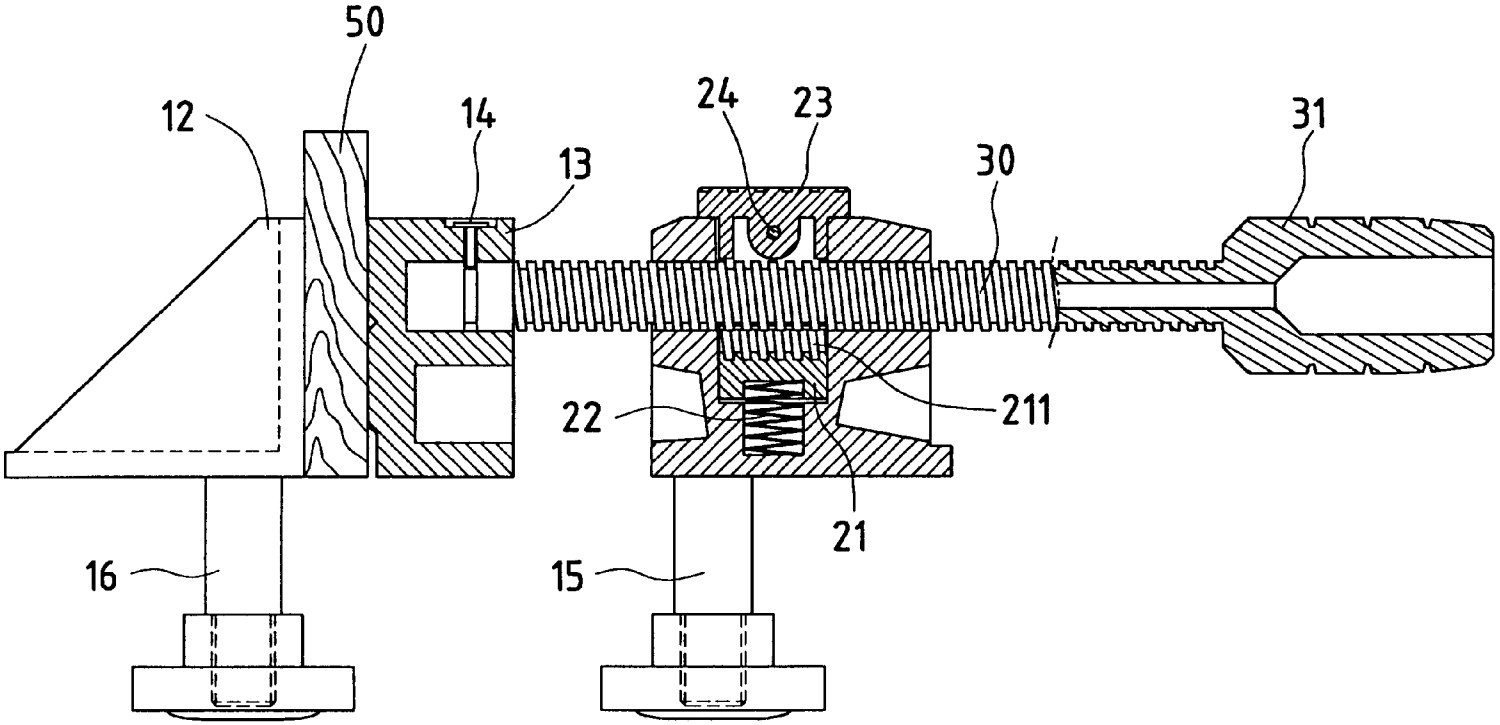
FIG. 6 is a cross-sectional view showing that the thread rod is disengaged from the thread of the chuck.

Please refer to FIGS. 3 and 4. The present invention includes a main body 10, a chuck assembly 20, a thread rod 30 and two guide rods 41, 42. The main body 10 include a main base seat 11, a back seat 12 and a clamping block 13. The chuck assembly 20 includes a chuck 21, a spring 22 and a cover board 23. An upper end of the main base seat 11 is formed with a downward extending deep socket 111 for receiving therein the chuck 21 and the spring 22. The main base seat 11 is formed with several three through holes 112, 113, 114 passing through the front and rear end faces thereof A back face of the clamping block 13 in front of the main base seat 11 is formed with three holes corresponding to the through holes of the main base seat 11. The thread rod 30 and guide rods 41, 42 pass through the through holes of the main base seat to insert into the holes of the back face of the clamping block 13. An upper end of the clamping block 13 is formed with a thread hole 131. A bolt 14 is screwed into the thread hole 131 to lock the thread rod 30 on the clamping block 13, whereby when rotating or moving the thread rod 30, the clamping block 13 is prevented from separating from the thread rod 30. The guide rods 41, 42 are fixed with the clamping block 13 and movable synchronously with the clamping block 13. Two opposite clamping faces of the clamping block 13 and the back seat 12 are formed with rough tooth mesh and cross-shaped channels for facilitating clamping of a work piece.

The chuck 21 has a substantially U-shaped cross-section. The inner side of the bottom of the chuck is formed with a 180 degrees thread 211 facing upward. The bottom face of the chuck 21 is formed with a central recess 212 facing downward. The thread 211 of the chuck 21 is engaged with the thread rod 30, whereby the clamping block 13 can be driven by means of rotating the thread rod 30. An end face of the spring 22 is guided into the recess 212 for fixing the position of the spring 22. The cover board 23 is connected with the chuck 21 via a pin 24 to form an integral body. The guide rods 41, 42 serve to stabilize the moving direction of the clamping block 13. A free end of the thread rod 30 is integrally disposed with a handle 31 for facilitating the rotation of the thread rod 30.

In operation, the work piece 50 is placed between the back seat 12 and the clamping block 13. One end of the work piece 50 is attached to the back seat 12. The cover board 23 is depressed so as to move down the chuck 21. At this time, the thread rod 30 is disengaged from the thread 211 of the chuck 21 and liberated. Under such circumstance, the clamping block 13 can be quickly slided to attach to the work piece 50. When the cover board 23 is released from the depressing force, the spring 22 immediately pushes the chuck 21 upward, making the thread 211 again engaged with the thread rod 30. At this time, the handle 31 can be rotated to rotate the thread rod 30 for driving the clamping block 13 to tightly clamp the work piece 50. Referring to FIGS. 5 to 8, when it is desired to loosen the work piece 50, the cover board 23 is further depressed and the handle 31 is held and pulled backward so as to quickly move the clamping block 13 away.

Figure 7:
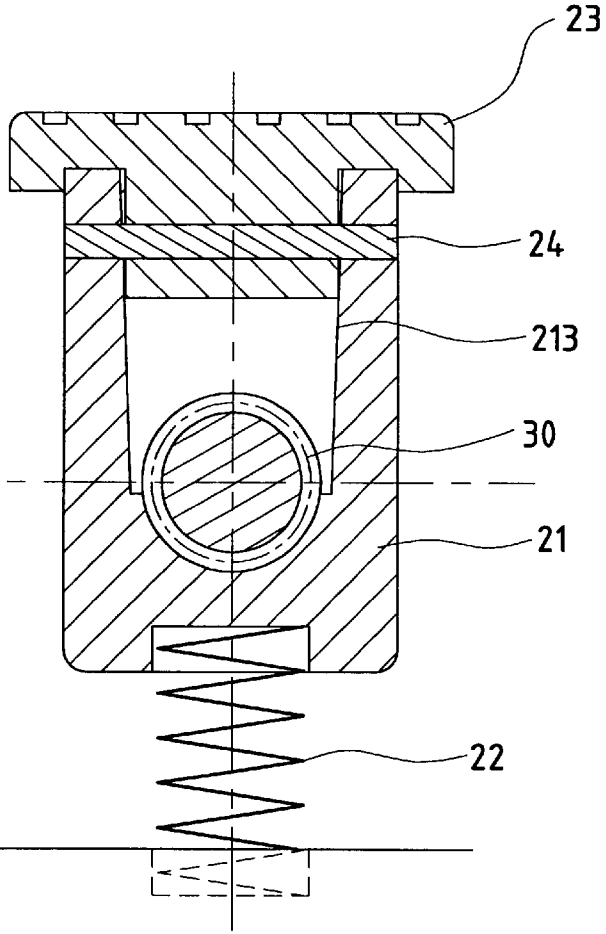
FIG. 7 is a longitudinal sectional view showing that the thread rod is engaged with the thread of the chuck.
Figure 8:
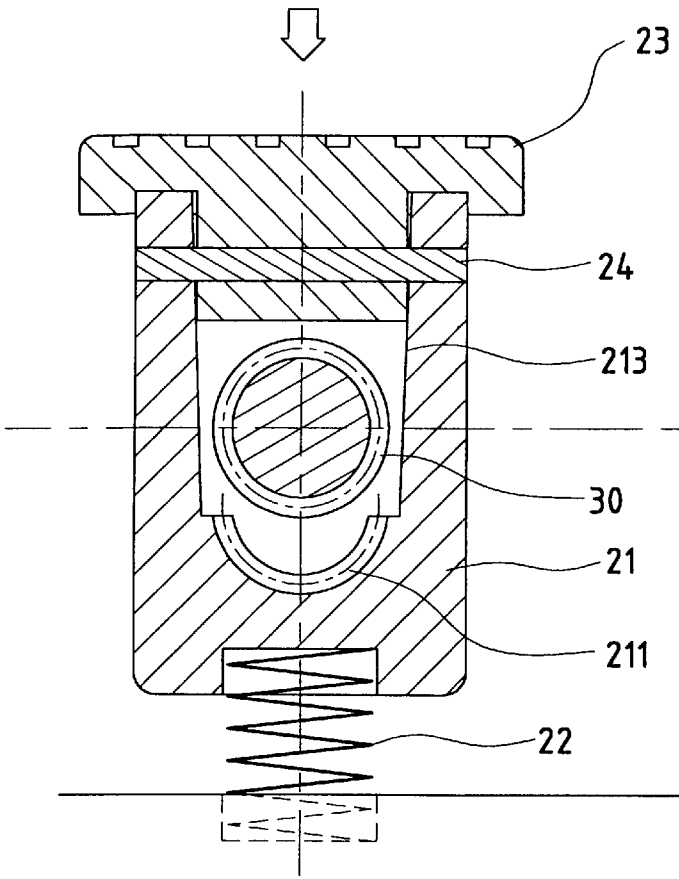
FIG. 8 is a longitudinal sectional view showing that the thread rod is disengaged from the thread of the chuck.

Please refer to FIGS. 7 and 8. The 180 degrees thread 211 maximizes the area of the forced cross-section of the chuck 21 so as to achieve a best engaging effect. In addition, the depressing force exerted onto the chuck 21 from the cover board 23 and resilient force exerted onto the chuck 21 from the spring 22 both have a direction normal the thread rod 30, so that the chuck 21 is most snugly and stably engaged with the thread rod 30.

Figure 9:
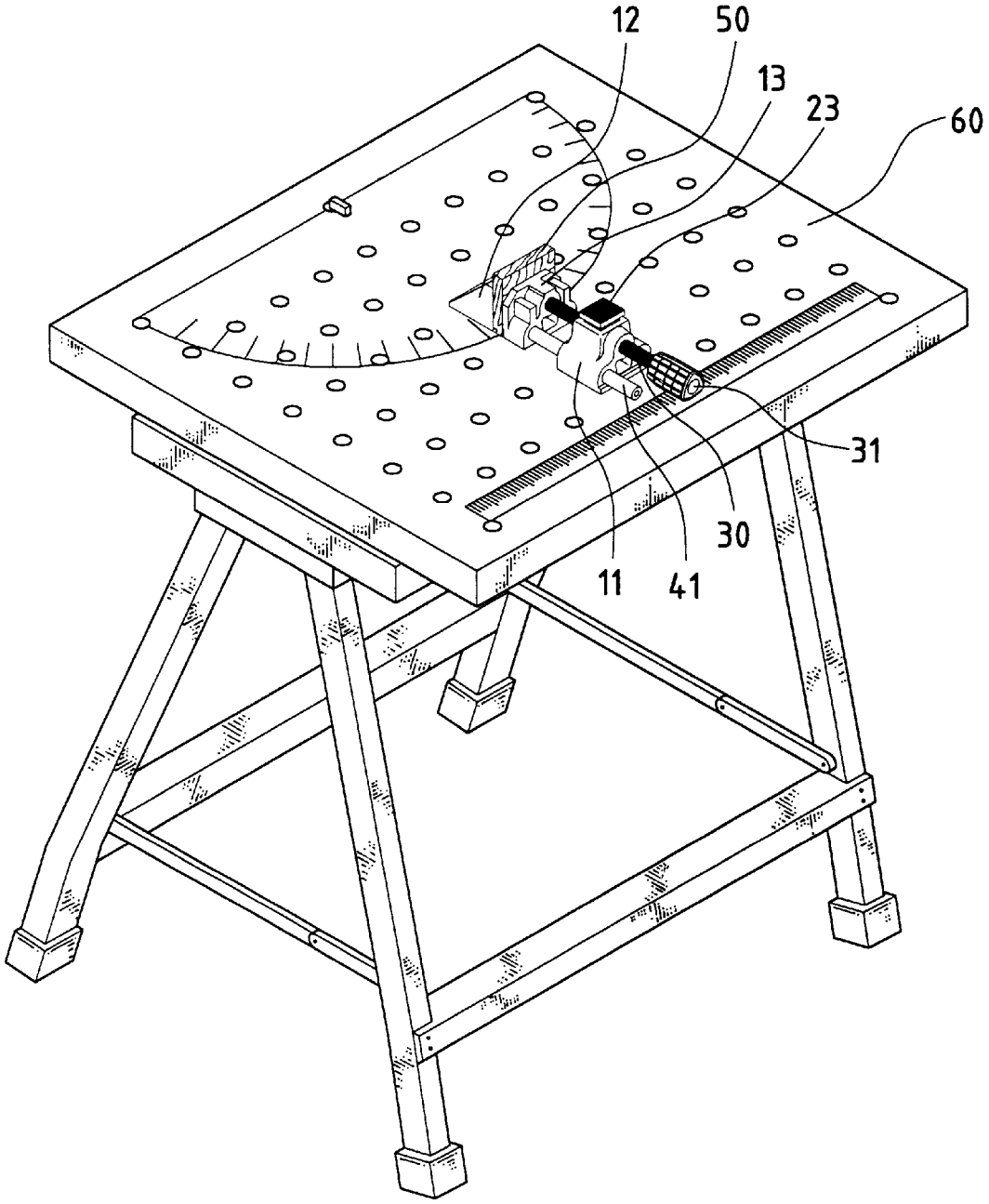
FIG. 9 shows the application of the present invention.
Figure 10A:
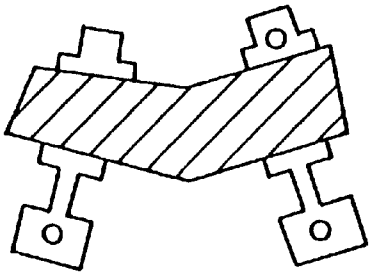
FIGS. 10A–10F show that the present invention is applied to clamping of irregular work pieces.
Figure 10B:
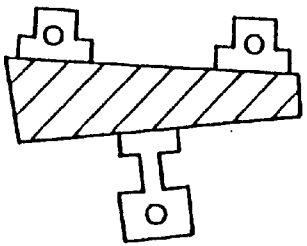
Figure 10C:
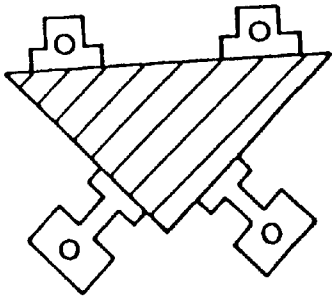
Figure 10D:
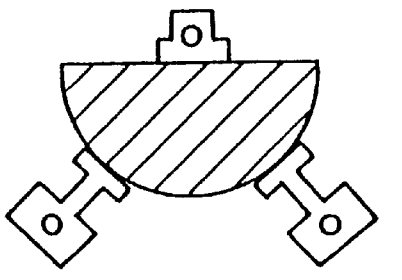
Figure 10E:
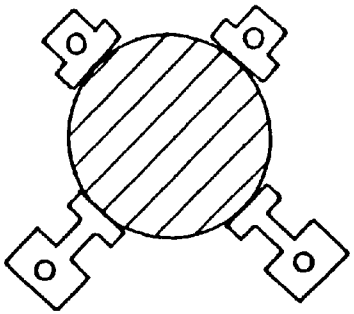
Figure 10F:
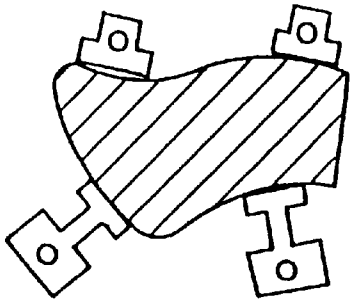

The present invention is applicable to various working benches. Referring to FIG. 9, the main base seat 11 and the back seat 12 can be fixed by fixing mechanisms 15, 16 on any position of the working bench 60, depending on the size of the work piece to be clamped. Therefore, a larger work piece 50 can be also clamped without limitation of the length of the thread rod 30. In addition, several sets of vices can be used at the same time. The positions of the main base seat 11 and the back seat 12 can be adjustably located at suitable positions in accordance with the profiles of the work pieces as shown in FIGS. 10A to 10F. Therefore, even various kinds of irregular work pieces can be easily clamped.

It should be noted that the above description and accompanying drawings are only used to illustrate some embodiments of the present invention, not intended to limit the scope thereof. Any modification of the embodiments should fall within the scope of the present invention.

What is claimed is:

1. A quick clamping type vice comprising:

a main base seat including an upper end and a deep socket formed in said upper end of said main base seat, said main base seat including front and rear end faces and several through holes passing through said front and rear end faces;

a back seat disposed opposite to the main base seat;

a clamping block including a clamping end face and a back face disposed between said main base seat and said back seat, said clamping block cooperating with said back seat for clamping a workpiece, said clamping end face of said clamping block being formed with rough teeth mesh and cross channels and said back face of said clamping block opposite to said clamping end face including several holes;

a chuck disposed in said deep socket of said upper end of said main base seat, said chuck having an upper side, a U-shaped cross section with a bottom portion and a bottom face, said bottom portion of said chuck being formed with a 180 degrees thread and said bottom face formed with an upwardly extending downward facing recess;

a spring disposed in said deep socket of said main base seat and the recess of the chuck for upward pushing and restoring the chuck to a home position;

a cover board disposed on and engaging said upper side of said chuck, and a pin connecting said cover board to said chuck to form an integral body for depression of said chuck against the face of said spring;

a thread rod including a first end and a handle at an opposite end thereof, said thread rod passing through said main base seat and riding on said chuck, said first end of said thread rod being guided and locked in the hole of said block face of said clamping block for driving the clamping block to move; and, several guide rods respectively passing through said through holes of said main base seat and fixedly inserted into the holes of said back face of said clamping block for restricting and stabilizing the moving direction of said clamping block, characterized in that at the same time said thread rod rides on the bottom of said chuck in said deep socket of said main base seat with said thread of said chuck engaging said thread rod via the resilient force of said spring under said chuck, the thread of the chuck stably engaged with the thread rod by 180 degrees, and when said cover board on said upper side of said chuck is depressed to thereby move said chuck downward to disengage from said thread rod and temporarily release said thread rod and when said cover board is released, the thread of said chuck again engages said thread rod, and when said thread of said chuck is disengaged from said thread rod, said clamping block being free to move, while when said thread of the chuck is engaged with the thread rod, via said handle, said rod being rotated to drive said clamping block to clamp the workpiece.

* * * * *